United States Patent [19]

Mierbach et al.

[11] Patent Number: 4,709,600

[45] Date of Patent: Dec. 1, 1987

[54] POWER SCREW DRIVER WITH A RATCHET WHEEL HAVING FINELY GRADUATED TOOTHING

[75] Inventors: Hans-Bernd Mierbach; Gustav K. Frohn, both of Königswinter; Olaf Blockisch, Hennf, all of Fed. Rep. of Germany

[73] Assignee: Applied Power, Inc., Milwaukee, Wis.

[21] Appl. No.: 800,065

[22] PCT Filed: Feb. 25, 1985

[86] PCT No.: PCT/DE85/00055

§ 371 Date: Oct. 25, 1985

§ 102(e) Date: Oct. 25, 1985

[87] PCT Pub. No.: WO85/03897

PCT Pub. Date: Sep. 12, 1985

[30] Foreign Application Priority Data

Feb. 28, 1984 [DE] Fed. Rep. of Germany ..... 3407126

[51] Int. Cl.[4] ..... B25B 13/46

[52] U.S. Cl. ..... 81/57.39; 81/57.44; 81/60; 81/58.3

[58] Field of Search ..... 81/57.39, 57.44, 59.1, 81/60, 58.3, 63.1, 63.2, 61, 62, 63, 57.18

[56] References Cited

U.S. PATENT DOCUMENTS

| | | | |
|---|---|---|---|
| 4,137,800 | 2/1979 | Austin | 81/57.39 |
| 4,201,099 | 5/1980 | Junkers | 81/57.39 |
| 4,339,968 | 7/1982 | Krieger | 81/57.39 |
| 4,409,865 | 10/1983 | Krautter et al. | 81/57.39 |

FOREIGN PATENT DOCUMENTS

| | | | |
|---|---|---|---|
| 0130465 | 1/1985 | European Pat. Off. | 81/57.39 |
| 1082610 | 3/1984 | U.S.S.R. | 81/57.39 |

*Primary Examiner*—Robert P. Olszewski
*Assistant Examiner*—Bradley I. Vaught
*Attorney, Agent, or Firm*—Bradford E. Kile

[57] ABSTRACT

The power screw driver has a power arm (2) and a reaction arm (1), as well as a ratchet wheel (7) and a multi-toothed pawl (8), that meshes with this ratchet wheel and that meshes with several teeth of the ratchet wheel (7) when the power arm (2) is in a rotational direction and when it is in the other rotational position, the pawl slips over the teeth of the ratchet wheel (7). Finally a hydraulic power cylinder is provided between the two arms (1, 2).

The power arm (2) has a drive head (9), which is inside the cylinder bore hole (11) and engages in a recess (14) of the piston (13). The cylinder bore hole runs obliquely, in particular at a right angle to the power arm (2).

3 Claims, 1 Drawing Figure

POWER SCREW DRIVER WITH A RATCHET WHEEL HAVING FINELY GRADUATED TOOTHING

FIELD OF THE INVENTION

The invention relates to a power screw driver with a power arm and a reaction arm, which can be rotated counterwise to one another around an axis, with finely graduated teeth, a rachet wheel that can be rotated around the axis, with a multi-toothed pawl that engages with this rachet wheel and that meshes with several teeth of the ratchet wheel in the meshing position when the power arm is rotating in one direction and when it is in the other rotational position the pawl slips over the teeth of the ratchet wheel, and with an hydraulic power cylinder, made of a cylinder and a piston that is attached between the two arms.

DESCRIPTION OF THE PRIOR ART

Such power screw drivers are known from several publications, for example, from DE-OS No. 30 08 381 (U.S. Pat. No. 4,440,046). In this prior art power screw driver, the cylinder bore is in the power arm; the piston is reinforced via an articulated arm at the reaction arm. On the basis of the ratchet wheel and the pawl having finely graduated toothing, small rotational angles of the power arm opposite the reaction arm are necessary in order to effect a rotary drive of the ratchet wheel. In this respect the toothing is designated as finely graduated if there are three or more teeth in an angular range of twenty degrees. This angular range is typical for the amount of angulation in the region of the power arm opposite the reaction arm.

In prior art power screw drivers the pawl is reinforced at the power arm via an articulated arm in a canal. Thus the reaction power train is unfavorable; it results is a long power train over and back, whereby a subsequent adjustment is necessitated via a grub screw.

One disadvantage of the prior art power screw driver is the relatively large number of individual parts of which it is made. Furthermore, the piston, which projects out of the force arm when it is swung out, must be protected against dirt. Unwanted dirt can also collect inside the piston that is open on one side and in which there is the articulated arm.

SUMMARY OF THE INVENTION

With the above as a starting point the purpose of the invention is to avoid the disadvantages of the power screw driver of the aforementioned type and to construct the known power screw driver in such a way that the most favorable power train possible is obtained between the hydraulic power cylinder and the ratchet wheel with as few individual parts as possible.

Starting the from the known power screw driver, this problem is solved by the fact that the power arm has a drive head that is located inside the cylinder bore and engages in the recess of the piston and that the cylinder bore is at a right angle to the connecting line of the axis and the drive head.

Thus a direct and compact power train is obviously obtained; the driving force of the piston, effecting the power arm, engages for all practical purposes in a ninety degree angle at the power arm, which can be constructed relatively simply. In the preferred embodiment the power train is symmetrical to a large degree; the piston is located in its mirror image to the connecting line between the axis and the drive head of the power arm. On the whole, a fairly closed construction is obtained in which the power arm is completely inside the reaction arm, which has a suitable recess for this.

In a particularly advantageous embodiment of the invention the piston has in the region of its recess at least one, preferably two, partially cylindrical, concave, first attachment surfaces whose center is located on the axis line. The drive head also has at least one, preferably convex, partially cylindrical, second attachment surfaces. The center point of this second attachment surface is displaced with respect to the movement of the power arm not only axially, as desired, but also somewhat radially. In order to keep this radial displacement as small as possible, it is averaged out on both sides of the axis line so that the center of the drive head in the mid-position of the power arm extends above the axis, whereas in the edge positions of the power arm it is below this line of axis.

As an alternative, extremely eccentric paths can be selected for the second attachment surfaces in which the center point of the circular arc is far away from the axis line of the cylinder and the path is selcted such that starting from the mid-position of the power arm with movement towards left or right, the contact point between the drive head and the first attachment surface stays in essence on the axis line of the cylinder.

In another, preferred embodiment of the invention the power arm is in essence inversely symmetrical to a straight line running through the axis and the center point of its drive head, whereby its general course is somewhat pear-shaped.

The power arm has preferably a recess for a pawl; this recess has a reaction surface with a lock-in flank and an essentially radial transmission region that attaches itself snugly to it. On the basis of its oblique course the snap flank makes sure that the pawl in a rotational direction of the power arm is forcibly pressed into engaging with the teeth of the ratchet wheel; the actual power train is effected then over a particularly short path via the essentially radial region of transmission in the absolute vicinity of the circumference of the ratchet wheel.

The pawl is preferably connected to the power arm via a spring. Furthermore, it has the shape of a three-quarter moon, whereby the reaction surface has the same diameter as the outer arc of the pawl; the toothing of the pawl are on the boundary line with the larger diameter of the pawl. On the whole the simplest construction possible is obtained through this technique, which offers special engineering advantages for production.

Other features and advantages of the invention result from the other claims and the following specifications of an embodiment, which is not to be understood as limiting and which is explained in detail in the following with reference to the drawing. This drawing shows in accordance with the invention a cross-section at right angles to the axis of the power screw driver.

BRIEF DESCRIPTION OF THE DRAWING

The FIGURE is a cross-sectional view of the invention.

DESCRIPTION OF THE PREFERRED EMBODIMENTS

Figure 1:
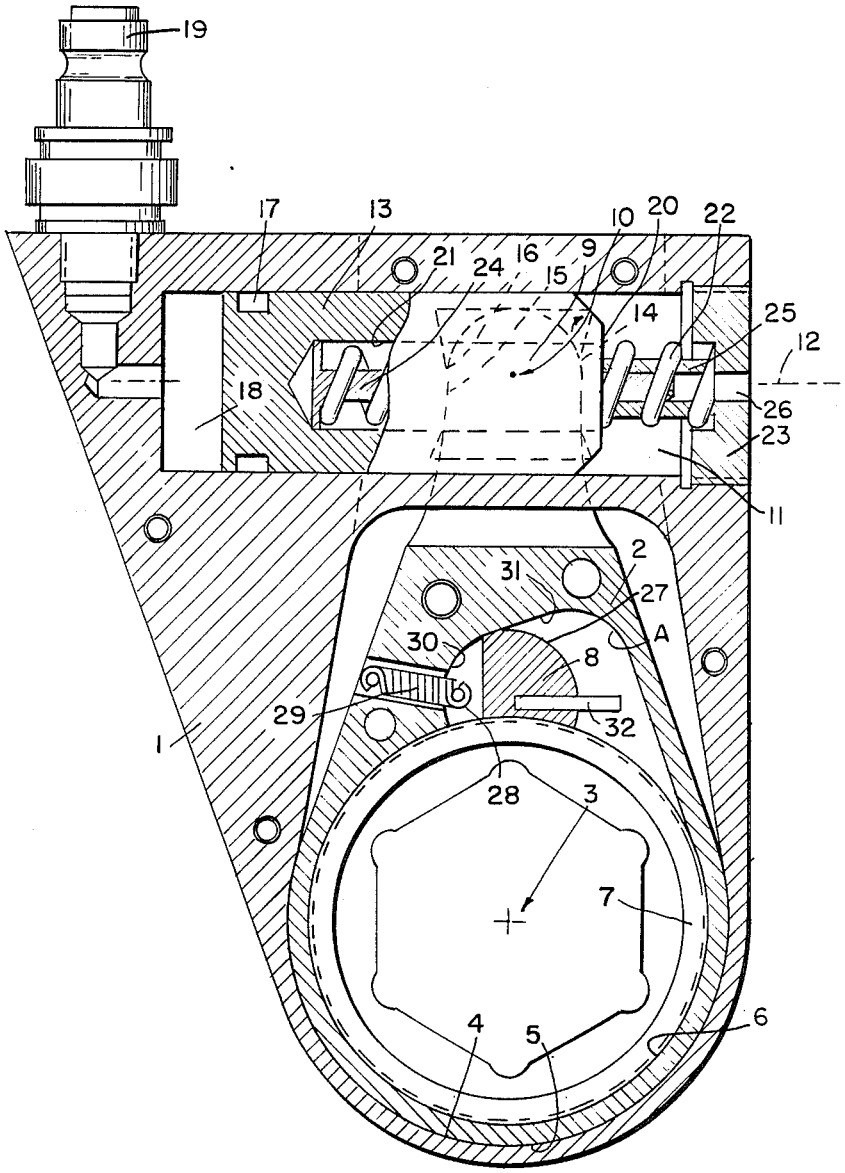

The power screw driver has a reaction arm 1 and a power arm 2 that are attached such that they can be rotated around an axis 3 counter clockwise to one another. For this purpose the reaction arm 1 has a partially cylindrical guiding surface 4 that extends over approximately 180° and to which the corresponding exterior of the power arm 2 is attached with a precision fit. The power arm 2 has in turn a cylindrical guiding surface 6 that extends over approximately 270° and that serves to guide and position the ratchet wheel 7. This wheel can at least be rotated around the axis 3 opposite the power arm 2 in a rotational direction. The latter in turn can be swung out of the indicated center point opposite the rigid reaction arm 1 at an angle of approximately + or −10°.

The ratchet wheel 7 has an interior hexagon for transferring a power driven screwing movement to a nut, a screw bolt, or similar thing. The ratchet wheel 7 has, moreover, a finely graduated toothing; for example, four teeth are within the total rotational region of the power arm of approximately 20°. A pawl 8 in the shape of a three-quarter moon engages with these teeth. The one, lower boundary line of the pawl with a larger radius has several teeth, for example 5. The construction and shape of these teeth of the pawl 8 correspond to the construction and shape of the teeth of the ratchet wheel 7.

The power arm is in essence shaped like a pear; it shifts upward into a spherical drive head 9, which is defined around a center point 10 by a circular arc, extending over a little more than 180°. This center point is on an axis running parallel to the axis 3. The power arm 2 is in essence inversely symmetrical with respect to a straight line connecting this center point 10 to the passage of the axis 3.

A cylinder 11, whose axis line 12 runs at a right angle from the center point 10 and the point of passage of the axis 3 to the aforementioned connecting line, is attached in the reaction arm 1. As the drawing shows, the center point 10 is somewhat above the axis line 12 in the indicated mid-position of the power arm 2; it intersects the axis line on the way into the left or right end position.

A piston 13, which is constructed as a plunger, is led into the cylinder 11. Together with the cylinder 11, it forms a hydraulic power cylinder, which supplies the necessary power for screwing. The piston 13 has a recess 14 approximately in its center region in which the drive head 9 of the power arm 2 engages formfitting to a large degree due to its shape. Thus the recess 14 forms two concave attachment surfaces 15, running at a right angle to the axis line 12, in the following first attachment surface at which the drive head 9 is reinforced around the center point 10 with its aforementioned second surface 16, having the same diameter. The attachment of both surfaces 15, 16 should be done as much as possible in one point, which is to a large degree exactly on the axis line 12 of the cylinder 11. In practice this requirement, however, cannot be exactly realized; it can only be approximated to a large degree.

Therefore, in a construction, deviating from the drawing, the course of the second attachment surface can be selected such that the contact point of the attachment surfaces 15, 16 remain in essence on the axis line. For the course of the second attachment surface 16, a circular arc must also be selected with a larger radius whose center point is outside the drive head 9.

In known constructions the piston is sealed via a seal 17 opposite the cylinder 11. Opposite this seal there is a pressure plenum 18, which can be filled via a canal and a suitable connecting piece 19 with hydraulic fluid.

The piston has an axial bore 21, leading out from its extremity 20 that is faced away from the pressure plenum. A screw pressure spring 22 for returning the piston is attached in the axial bore 21. On the basis of the axial bore 21, a relatively long screw pressure spring 22 may be selected. This is reinforced with its other extremity at a nut 23, which is screwed into the open end of the cylinder 11. An internal thread is provided for this in the cylinder 11. A pin 24 with a plate-like extremity is pressed via the screw pressure spring 22 against the end of the axial bore 21. The pin is at least partially within a casing 25, which is held in the nut 23 and encompassed by the screw pressure spring 22. The nut 23 has a access bore hole 26 for the pin 24. On the whole a construction that is for all practical purposes sealed against the outside is achieved.

The matter with the pin 24 is as follows: Upon termination of the rotational stroke, the piston 13 is further to the right than is shown in the drawing. The piston also takes the pin 24 with it until its front end is visible in the access bore hole 26. This process makes the rotational state of the power arm 2 visible, in particular, however, the end position. Thus a user can determine whether the screwing process has finished. Namely, if with the piston 13, driven with pre-set hydraulic pressure, the pin 24 is not visible in the access bore hole 26, the pressure did not suffice for any further screwing. Thus the desired amount of screwing was obtained.

The pawl 8 has the shaped of a flat circular disk, which has a concave recess at the edge with the diameter of the toothing of the ratchet wheel 7. On the whole the aforementioned three-quarter moon is obtained. The boundary line with the larger diameter, also the diameter of the teeth of the ratchet wheel 7, does not extend to the center point of the boundary arc 27 of the pawl 8 but rather is 1/10 of the diameter of the boundary arc 27 distant from it. A ratchet spring, running horizontally through the center point of the boundary arc 27 is attached to the pawl 8 and a ratchet spring 29 is attached at a pin 28 in the left region of the margin. The ratchet spring is primarily in a canal of the power arm 2 and is held there by its other end.

The recess A has a reaction surface in its left region with which the pawl 8 engages. The recess is comprised of a transmission region 30, running primarily radially, and a lock-in flank 31 that adjoins the transmission region. The transmission region 30 is partially cylindrical; it extends over approximately 90° and meets tangentially in the lock-in flank 31, which intersects the connecting line of the center point 10 and the axis 3 approximately at a 70° angle.

The drawing shows a drive position, as it occurs when the pressure plenum 18 is filled under pressure with hydraulic fluid, that moves the piston 13 further to the right. The pawl 8 is in the engaging position; it is adjacent to the transmission region 30. This transfers the motive force to the pawl 8; power transmission is effected thereby under a favorable angle and on the shortest path.

The described working stroke has ended when the piston 13 has taken the drive head 9 with it into the right terminal position to the right and the pin 24 can be seen in the access bore hole. Then the return working stroke of the piston 13 is effected under the influence of the screw pressure spring 22, as soon as the pressure plenum 18 is without pressure. In this case the pawl 8 remains, first of all, in the designated engaging position. While the piston 13 is moving back and the power arm 2 is rotating back, the ratchet spring 29, however, is expanding and trying to pull back the pawl 9. If the pawl 8 gets stuck in the teeth of the ratchet wheel 7, it will be pushed out of the teeth at the latest when a rod 32 that is rigidly connected to the pawl 8, strikes against the inner wall of the recess A. The rod is attached in a horizontal position, running through the center point of the boundary arc 27, and projects a few millimeters to the right.

Other means to reinforce the disengagement of the pawl 8 can be provided: For example, a spring, which reaches under and lifts up the pawl 8 or its rod 32, can project into the recess A, if the pawl 8 stays back too far with respect to the transmission region 30. A pin of the power arm 2, attached parallel to the axis 3, can also project into the recess 14, which tilts, if the occasion arises, the mounting and frees the pawl 8 from its engagement with the teeth of the ratchet wheel 7.

With the continuation of the return rotation movement, the pawl 8 glides over the teeth of the ratchet wheel 7 until the piston 13 is in its left terminal position. The pawl 8 does not generally find itself in this state, i.e. the engagement position, as the drawing shows. Rather it is pre-loaded in this engagement position on the basis of the lock-in flank 31, running obliquely, and the tensile force of the ratchet spring 29. Engagement is again produced if a renewed working stroke begins. Then the lock-in flank and the ratchet spring 29 pull the pawl 8 into the engagement position as soon as the teeth of the pawl 8 and the teeth of the ratchet wheel 7 are in the correct position with respect to one another for this process. Then the aforementioned process starts all over again.

The transmission region 30 and/or the lock-in flank 31 can be boundary surfaces of separate parts that are held via suitable screws at the power arm 2 and can be trivially adjusted with respect to the power arm in order to have the possibility of adjustment in case it gets worn down.

The power screw driver is comprised of relatively few individual parts that are also easy to manufacture. The majority of the parts can even be made from simple sheet stamping parts. Since the cylinder 11 is mounted in the stationary reaction arm 1, the problem of the hydraulic pipe, which is attached to the connecting piece 19, moving with each stroke, is avoided in contrast to the prior-art power screw driver.

Instead of the indicated return position of the piston 13 via a screw pressure spring 22, a double-acting piston can also be employed. Then there would also be a pressure plenum on the other side.

One could also provide for a situation in which the drive head 9 is always adjacent at the top of the interior of the recess 14 if one makes sure that the power arm 2 can be displaced a little with respect to the reaction arm 1, and in particular in the longitudinal direction of this power arm 2. In this case, the guiding surface 4 of the reaction arm 1 could extend only over 180° and would have to be guided a little further tangentially some few milliments so that the power arm 2 can move a little upwards and so that there is a small sliver of space between 4 and 5, if the piston 13 pushes the power arm to the left or the right, in any event out of the designated mid-position. Thus the drive head 9 could be held either form-fitting in the piston 13 or pre-loaded via a spring at the upper wall of the recess 14. Thus with the designated geometry in the region of the drive head 9 its center point 10 remains constant on the axis line 12.

We claim:

1. A wrench for rotating a work tool comprising:

a housing including a reaction arm, a drive arm connected to said reaction arm for rotational movement relative thereto about a rotation axis extending perpendicular to said drive arm and said reaction arm;

a ratchet wheel received in said drive arm for rotational movement about said rotation axis upon operational rotation of said drive arm in a first direction of rotation;

a spring-loaded pawl housed within said drive arm for drivingly connecting said ratchet wheel to said drive arm upon rotational movement thereof in said first direction of rotation but allowing free rotational movement of said drive arm about said ratchet wheel in a second opposite direction of rotation, a piston and cylinder assembly connected to said housing along a driving axis perpendicular to said rotation axis of said drive arm, said assembly including a cylinder and a piston within the cylinder operable to translate within the cylinder;

arcuate shaped coupling means connected between said said drive arm and said piston for converting reciprocating movement of the piston relative to the cylinder into rotational movement of said drive arm relative to said reaction arm, said coupling means including, a recess provided in said piston, and a head provided on said drive arm and being slidably received within said recess in said piston, said head and said recess comprising compatibly dimensional convex and concave surfaces designed for mutual engagement and said head and said recess having contact points substantially along said driving axis of said piston throughout the movement of said piston within said cylinder; and a return spring axially extending between said cylinder and said piston and through a bore fashioned through said head of said drive arm for operably providing an elongate return stroke of said piston.

2. A wrench for rotating a work tool comprising:

a housing including a reaction arm, a drive arm connected to said reaction arm for rotational movement relative thereto about a rotation axis extending perpendicular to said drive arm and said reaction arm;

a ratchet wheel received in said drive arm for rotational movement about said rotation axis upon operational rotation of said drive arm in a first direction of rotation;

a spring-loaded pawl housed within said drive arm for drivingly connecting said ratchet wheel to said drive arm upon rotational movement thereof in said first direction of rotation but allowing free rotational movement of said drive arm about said ratchet wheel in a second opposite direction of rotation, wherein said springloaded pawl is three-quarter moon shaped and a reaction surface on said drive arm has a diameter substantially identical with an exterior boundary surface of said pawl and a plurality of ratchet teeth are provided on a concave surface having a diameter larger than the diameter of said reaction surface of said three-quarter moon shaped pawl for engagement with an exterior surface of said ratchet wheel;

a piston and cylinder assembly connected to said housing along a driving axis perpendicular to said rotation axis of said drive arm, said assembly including a cylinder and a piston within the cylinder operable to translate within the cylinder;

arcuate shaped coupling means connected between said said drive arm and said piston for converting reciprocating movement of the piston relative to the cylinder into rotational movement of said drive arm relative to said reaction arm, said coupling means including, a recess provided in said piston, and a head provided on said drive arm and being slidably received within said recess in said piston, said head and said recess comprising compatibly dimensional convex and concave surfaces designed for mutual engagement and said head and said recess having contact points substantially along said driving axis of said piston throughout the movement of said piston within said cylinder.

3. A wrench for rotating a work tool comprising:

a housing including a reaction arm, a drive arm connecting to said reaction arm for rotational movement relative thereto about a rotation axis extending perpendicular to said drive arm and said reaction arm;

a ratchet wheel received in said drive arm for rotational movement about said rotation axis upon operational rotation of said drive arm in a first direction of rotation;

a spring-loaded pawl housed within said drive arm for drivingly connecting said ratchet wheel to said drive arm upon rotational movement thereof in said first direction of rotation but allowing free rotational movement of said drive arm about said ratchet wheel in a second opposite direction of rotation, wherein said springloaded pawl is three-quarter moon shaped and a reaction surface on said drive arm has a diameter substantially identical with an exterior boundary surface of said pawl and a plurality of ratchet teeth are provided on a concave surface having a diameter larger than the diameter of said reaction surface of said three-quarter moon shaped pawl for engagement with an exterior surface of said ratchet wheel;

a piston and cylinder assembly connected to said housing along a driving axis perpendicular to said rotation axis of said drive arm, said assembly including a cylinder and a piston within the cylinder operable to translate within the cylinder;

arcuate shaped coupling means connected between said said drive arm and said piston for converting reciprocating movement of the piston relative to the cylinder into rotational movement of said drive arm relative to said reaction arm, said coupling means including, a recess provided in said piston, and a head provided on said drive arm and being slidably received within said recess in said piston, said head and said recess comprising compatibly dimensional convex and concave surfaces designed for mutual engagement and said head and said recess having contact points substantially along said driving axis of said piston throughout the movement of said piston within said cylinder; and a return spring axially extending between said cylinder and said piston and through a bore fashioned through said head of said drive arm for operably providing an elongate return stroke of said piston.

* * * * *